US007360845B2

(12) United States Patent
Ojanen

(10) Patent No.: US 7,360,845 B2
(45) Date of Patent: Apr. 22, 2008

(54) COLD-FORMED ROTATABLE CUTTING TOOL AND METHOD OF MAKING THE SAME

(75) Inventor: Randall W. Ojanen, Bristol, TN (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 11/259,183

(22) Filed: Oct. 26, 2005

(65) Prior Publication Data

US 2007/0090680 A1 Apr. 26, 2007

(51) Int. Cl.
*E21C 35/18* (2006.01)

(52) U.S. Cl. ..... 299/110; 299/95; 72/377

(58) Field of Classification Search ..... 299/110, 299/95

See application file for complete search history.

(56) References Cited

U.S. PATENT DOCUMENTS 3,189,993 A * 6/1965 Whitted et al. ..... 29/527.1
4,159,746 A 7/1979 Wrulich et al.
4,485,655 A 12/1984 Ewing
4,627,665 A * 12/1986 Ewing et al. ..... 299/113
4,850,649 A 7/1989 Beach et al.
4,886,710 A 12/1989 Greenfield
5,141,289 A 8/1992 Stiffler
5,297,643 A 3/1994 Montgomery, Jr. et al.
5,324,098 A 6/1994 Massa et al.
5,529,384 A 6/1996 Ojanen et al.
6,312,529 B1 11/2001 Leap et al.
6,341,823 B1 * 1/2002 Sollami ..... 299/110
6,397,652 B1 * 6/2002 Sollami ..... 72/360
6,824,225 B2 11/2004 Stiffler
6,851,758 B2 2/2005 Beach

OTHER PUBLICATIONS

Cummins, Arthur, SME Mining Engineering Handbook vol. 1, Illustration (FIG. 11-3) p. 11-4 (1973).
Internet Advertisement Printout Wirtgen Products (1 page), no date.
"Appendix C" Overhead Slide made for technical lecture to Virginia Tech Students, used each Fall from 1992-2003.

* cited by examiner

*Primary Examiner*—John Kreck
(74) *Attorney, Agent, or Firm*—Matthew W. Smith

(57) ABSTRACT

A cutting tool body includes a net-shaped steel body that has an axial forward end and an axial rearward end. The net-shaped steel body contains at the axial forward end thereof a cold-headed socket. The net-shaped steel body further contains a cold-headed puller groove axial rearward of the cold-headed socket.

2 Claims, 5 Drawing Sheets

COLD-FORMED ROTATABLE CUTTING TOOL AND METHOD OF MAKING THE SAME

BACKGROUND OF THE INVENTION

The present invention relates to a rotatable cutting tool, which is a component of an earth-working apparatus, used to impinge upon earth strata such as, for example, asphaltic roadway material or ore-bearing or coal-bearing earth (or mineral) formations. More specifically, the present invention pertains to such a rotatable cutting tool that includes a cutting tool body that contains a hard cutting tip at the axial forward end thereof and wherein the cutting tool body has improved strength properties.

Heretofore, a rotatable cutting tool has been used to impinge upon earth strata, such as for example, asphaltic roadway material or ore-bearing or coal-bearing earth (or mineral) formations and the like. Such a rotatable cutting tool typically comprises an elongate cutting tool body that has an axial forward end and an axial rearward end. In one embodiment of such a cutting tool, the cutting tool body has a socket at the axial forward end wherein the socket receives a hard cutting tip. In another embodiment of such a cutting tool, the cutting tool body contains a projection at the axial forward end thereof wherein the projection is received within a socket (or recess) in the hard cutting tip. In each one of the above embodiments, the hard cutting tip is affixed to the cutting tool body by brazing or the like.

As can be appreciated, during operation the entire rotatable cutting tool is typically subjected to a variety of extreme cutting forces in an abrasive and erosive environment. It would be undesirable for the cutting tool body to prematurely wear or fail (whether it be through catastrophic fracture or the like or through abrasive or erosive wear) prior to the hard cutting tip wearing to the point of its useful life. In such a circumstance, the rotatable cutting tool would have to replaced prior to the normally scheduled time for replacement. Further, the premature failure of the rotatable cutting tool would negatively impact the cutting or milling efficiency of the overall earthworking apparatus. It thus becomes apparent that it is important that the cutting tool body possess the requisite strength to maintain its integrity during the intended useful life of the rotatable cutting tool.

Heretofore, some portions of the cutting tool body have been formed via a cold-heading or cold-forming process. One exemplary patent is U.S. Pat. No. 4,627,665 to Ewing et al. that shows the cold-forming of a cutting tool body. However, it should be appreciated that a number of steps are necessary to form certain portion of the cutting tool body. For example, the puller groove is formed via a separate roll-forming operation while the socket and the axial forward portion of the rotatable cutting tool is formed via a cold-heading process. U.S. Pat. No. 6,397,652 to Sollami is another example of a patent that shows a cutting tool body formed by a cold forming process.

Other cutting tool bodies are made via a process in which at least some of the cutting tool body is manufactured through a process that includes a machining step. The puller groove is a portion of the cutting tool body that typically has been machined. While the machined puller groove performs satisfactorily, the fact that a machining process occurs tends to weaken or reduce the strength of the cutting tool body. Further, machining a portion of the cutting tool body (e.g., the puller prove) results in the loss of the material machined out of the blank (or stock material) to form the puller groove.

It can therefore be appreciated that it would be desirable to provide an improved cutting tool body that exhibits improved strength properties. It can also be appreciated that it would be desirable to provide an improved cutting tool body that avoids machining in the manufacture thereof so as to reduce the amount of raw material necessary to make the rotatable cutting tool.

SUMMARY OF THE INVENTION

In one form thereof, the invention is a cutting tool body that comprises a net-shaped steel body that has an axial forward end and an axial rearward end. The net-shaped steel body contains at the axial forward end thereof a cold-headed socket. The net-shaped steel body further contains a cold-headed puller groove axial rearward of the cold-headed socket.

In another form thereof, the invention is a rotatable cutting tool that comprises a net-shaped steel body having an axial forward end and an axial rearward end. The net-shaped steel body contains at the axial forward end thereof a cold-headed socket. The net-shaped steel body further contains a cold-headed puller groove axial rearward of the cold-headed socket. The rotatable cutting tool further includes a hard cutting tip that is affixed to the net-shaped steel body at the socket.

In yet another form thereof, the invention is a method of making a cutting tool body comprising the steps of: providing a stock material having an axial forward end; and simultaneously cold-forming a socket in the axial forward end of the stock material and a puller groove at a location axial rearward of the socket.

BRIEF DESCRIPTION OF THE DRAWINGS

The following is a brief description of the drawings which form a part of this patent application.

DETAILED DESCRIPTION

Figure 1:
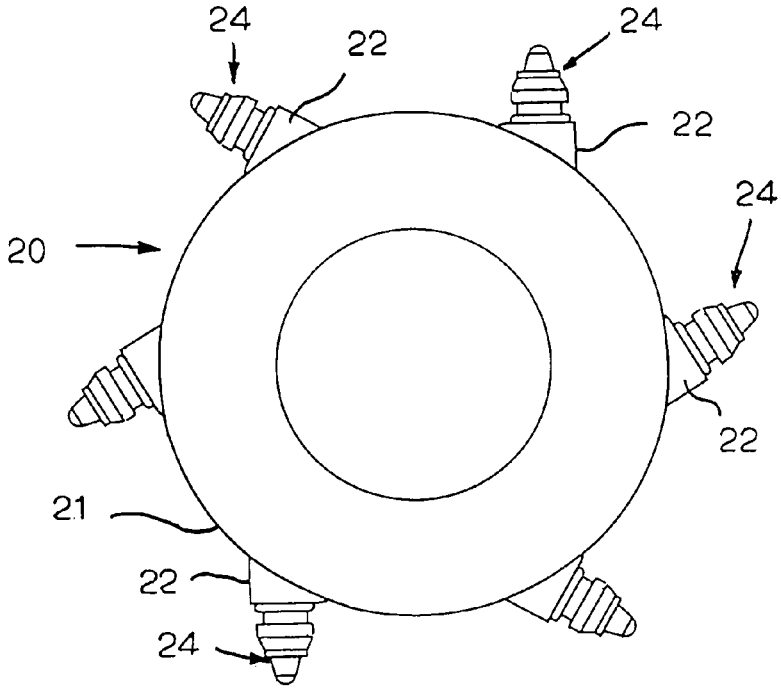
FIG. 1 is a mechanical schematic side view of a rotatable drum of an earthworking apparatus wherein the drum carries a plurality of cutting tool holders wherein each one of the cutting tool holders rotatably carries a rotatable cutting tool.

Referring to the drawings, FIG. 1 shows a rotatable drum generally designated as 20 that has a peripheral surface 21. The rotatable drum 21 is a part of an earthworking apparatus (not illustrated) that is used to impact and disintegrate earth strata (e.g., asphaltic material on roadways, minerals, rock and the like). Exemplary earthworking apparatus include road planing (or milling) machines that plane or mill roadway surfaces and mining machines that mine coal or ore deposits and the like.

A plurality of cutting tool holders (or blocks) 22 are affixed (typically by welding) (typically in a helical pattern) to the peripheral surface 21 of the rotatable drum 20. Each one of the cutting tool holders 22 carries a rotatable cutting tool generally designated as 24.

Figure 2:
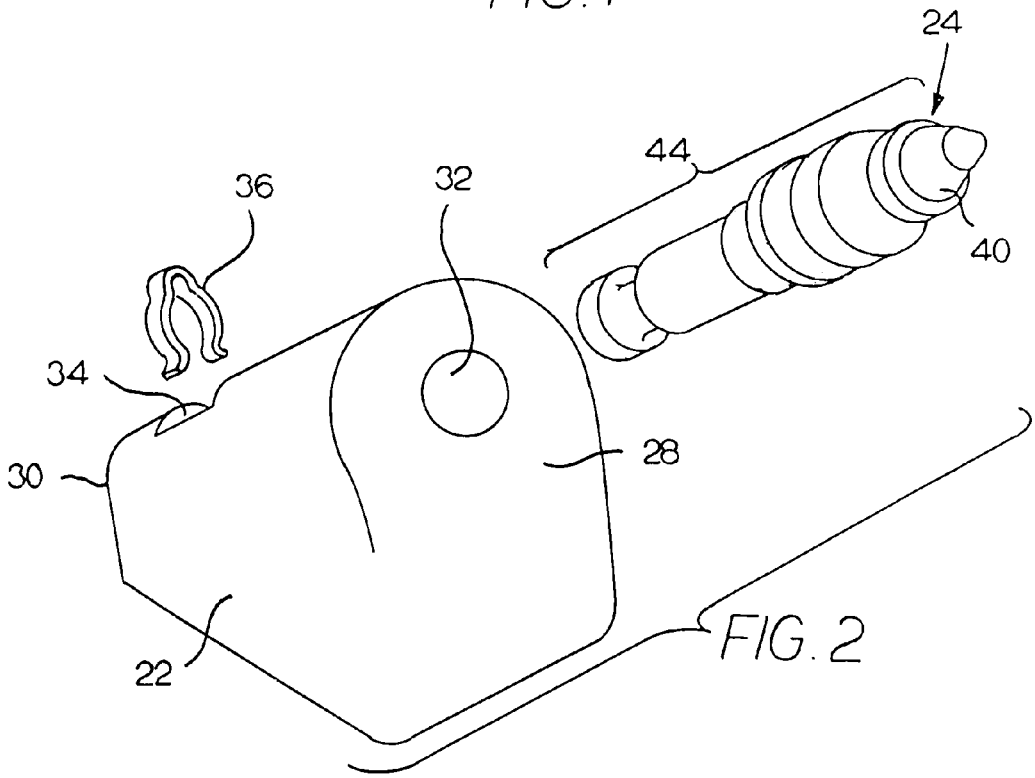
FIG. 2 is an isomeric view of a rotatable cutting tool exploded from a cutting tool holder and a retainer clip exploded from the cutting tool holder.

As shown in FIG. 2, each one of the cutting tool holders 22 has a forward end 28 and a rearward end 30. The cutting tool holder 22 contains a longitudinal bore 32 that opens at the forward end 28 of the cutting tool holder 22. The cutting tool holder 22 further contains an opening 34 adjacent the rearward end 30 whereby opening 34 is in communication with the longitudinal bore 32.

Figure 3:
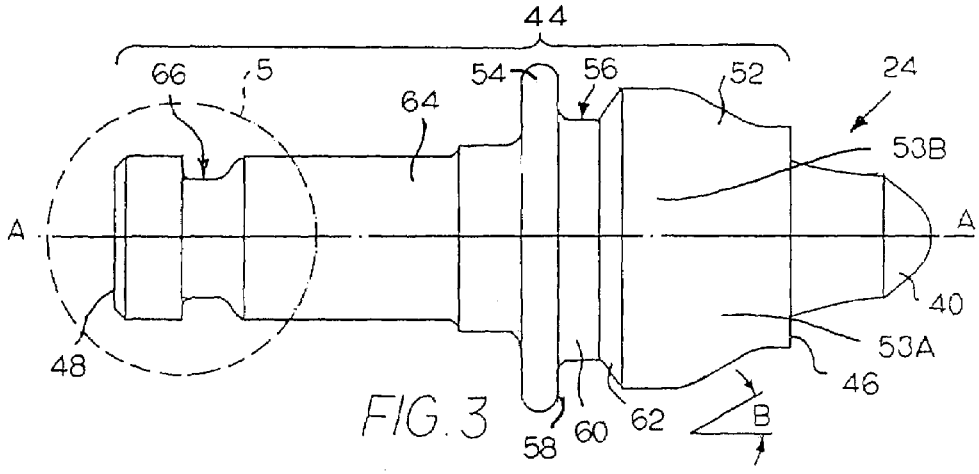
FIG. 3 is a side view of a specific embodiment of a rotatable cutting tool wherein the hard cutting tip is affixed to the elongate steel cutting tool body.
Figure 4:
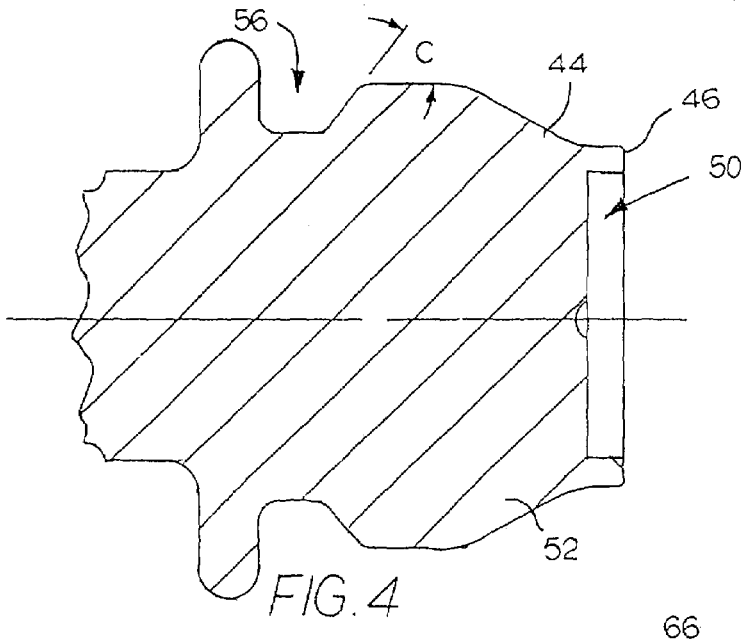
FIG. 4 is a cross-sectional view of the axial forward portion of the cutting tool body of the rotatable cutting tool embodiment of FIG. 3.
Figure 5:
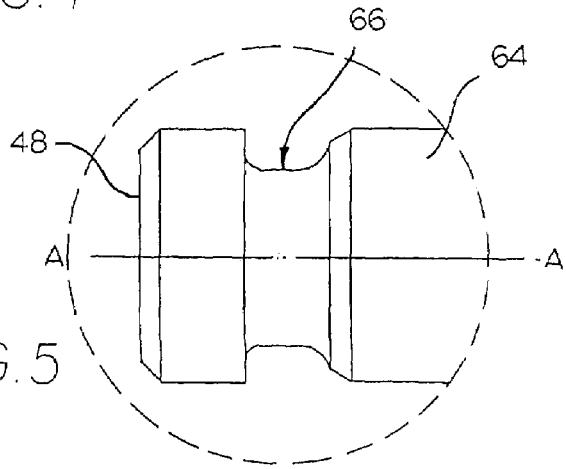
FIG. 5 is a side view of the axial rearward portion of the rotatable cutting tool of the rotatable cuffing tool embodiment of FIG. 3.

Referring to FIG. 3 through FIG. 5, rotatable cutting tool 24 includes an elongate cutting tool body designated by brackets 44. Cutting tool body 44 has an axial forward end 46 and an axial rearward end 48. Cutting tool body 44 contains a socket 50 at the axial forward end 46 thereof. The edge that helps defines the socket 50 is rounded.

The cutting tool body 44 has a head portion 52 (See FIG. 3) that is axial rearward of the socket 50 and a flange portion 54 that is axial rearward of the head portion 52. The head portion 52 includes a generally angled portion 53A wherein this portion is disposed at an angle B (see FIG. 3). Angle B ranges between about ten (10) degrees and about forty-five (45) degrees. As another range, angle B ranges between about twenty-five (25) degrees and about thirty-five (35) degrees. Head portion 52 further includes a cylindrical portion 53B that has a surface that is generally parallel to the central longitudinal axis A-A of the cutting tool body.

The cutting tool body 44 further contains a puller groove generally designated as 56 wherein the puller groove is between (or axial rearward of) the head portion 52 and (axial forward of) the flange 54 of the cutting tool body 44. The puller groove 56 is defined by a rear surface 58, which comprises the forward facing surface of the flange 54, a cylindrical mediate surface 60 and a forward surface 62, which is disposed at an angle "C" (see FIG. 4) to the central longitudinal axis A-A of the cutting tool body 44.

The rear surface 58 is disposed so as to be generally perpendicular to the central longitudinal axis A-A of the cutting tool body. However, it should be appreciated that the orientation of the rear surface 58 could be such that the orientation between about ninety (90) degrees and about one hundred twenty (120) degrees with respect to the longitudinal axis A-A. The angle C is equal to about thirty-six (36) degrees and can range between about twenty-five (25) degrees and about forty-five (45) degrees.

The cutting tool body 44 further includes a rearward shank portion 64 that contains a retainer groove 66 adjacent to the axial rearward end 48 of the cutting tool body 44.

Referring to FIG. 2, it can be appreciated that the rotatable cutting tool 20 is rotatably retained within the bore 32 of the cutting tool holder 22 by the engagement of the retainer 36 in the retainer groove 66. Generally speaking, such a structure is known in the art to retain the cutting tool within the bore of a holder.

It should be appreciated that other styles of retainers, and corresponding axial rearward portions of the cutting tool body, can be used to rotatably retain the cutting tool within the bore of the holder. In this regard, exemplary retainer arrangements, some of which may require a somewhat different geometry of the axial reward portion of the cutting tool body, are shown and described in the following U.S. Pat. No. 5,324,098 to Massa et al., U.S. Pat. No. 6,851,758 to Beach, and U.S. Pat. No. 4,850,649 to Beach et al.

Figure 6:
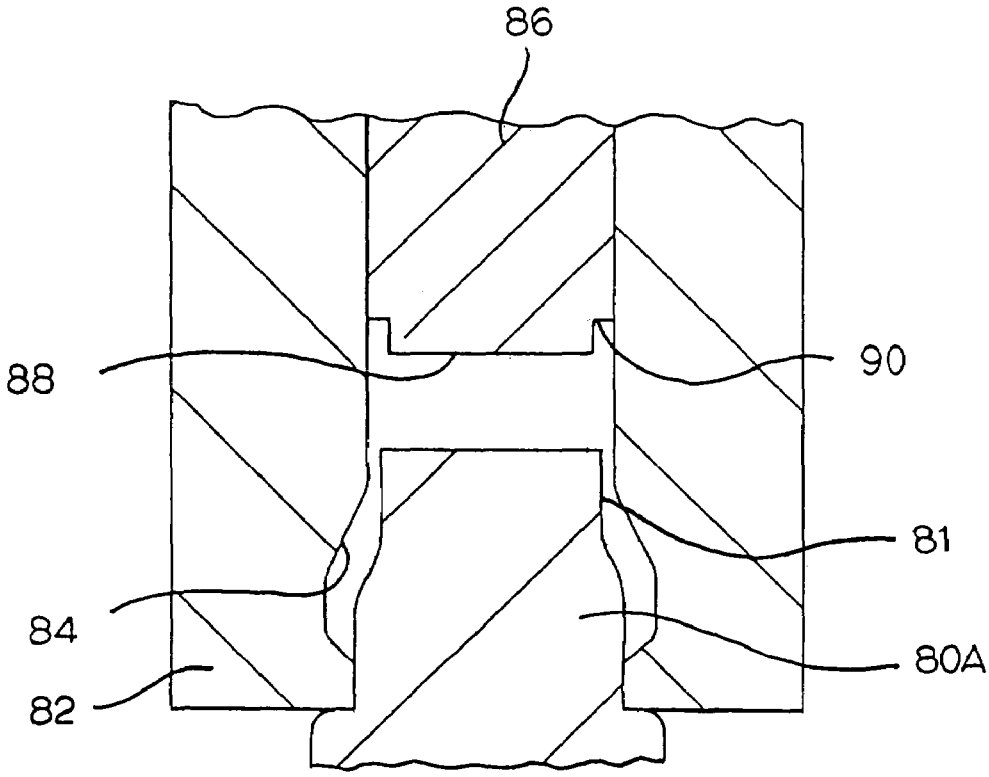
FIG. 6 is a cross-sectional view of the cold-heading (segmented) die and a ram, as well as a piece of stock material formed into the configuration illustrated, prior to the formation of the puller groove and the socket in the cutting tool body.

Referring to FIG. 6, there is shown a punch 86 and segmented die 82 set-up for the cold-heading of the puller groove and the socket in the forward end of the cutting tool body. The die 82 contains a geometry (identified as 84) for the formation of the puller groove. The punch 86 contains a forward portion 88 for the formation of the socket in the cutting tool body. A blank (or stock piece of material) 80A is positioned within the die 82. FIG. 6 shows the blank 80A in the die 82 and the punch 86 in such a position that it has not yet engaged or contacted the blank 80A.

It should be appreciated that the stock material 80A has been pre-formed from a cylindrical piece into the geometry (or configuration) illustrated in FIG. 6. In this regard, a smaller diameter portion 81 of the stock material 80A is located in the region of the die that forms the head portion of the cutting tool body. This geometry facilitates the appropriate movement of metal (or material, e.g., steel) to essentially completely fill the die cavity.

Figure 7:
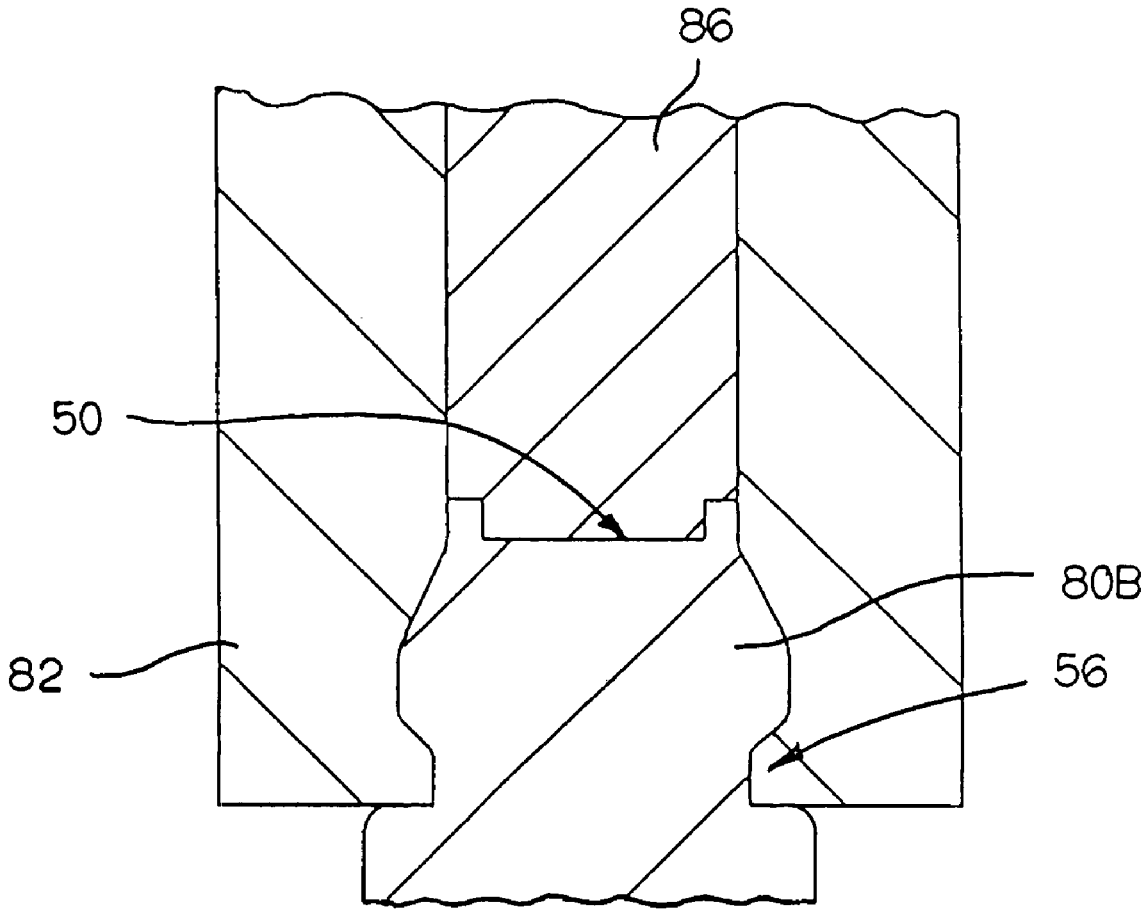
FIG. 7 is a cross-sectional view of the cold-heading die and the ram, as well as the stock material, after the complete of the formation of the puller groove and the socket in the cutting tool body.

Referring to FIG. 7, the punch 86 is shown at the completion of its travel so as to form the metal of the blank 80A into the puller groove and the socket. It can be seen that under the influence of the movement of the punch the metal moves from the axial forward end of the blank to create the socket and metal moves into the space between the blank and the die wall (as shown in FIG. 6) so as to form the puller groove. What this means is that the puller groove and the socket are simultaneously cold formed in the upset form forming process.

Figure 8:
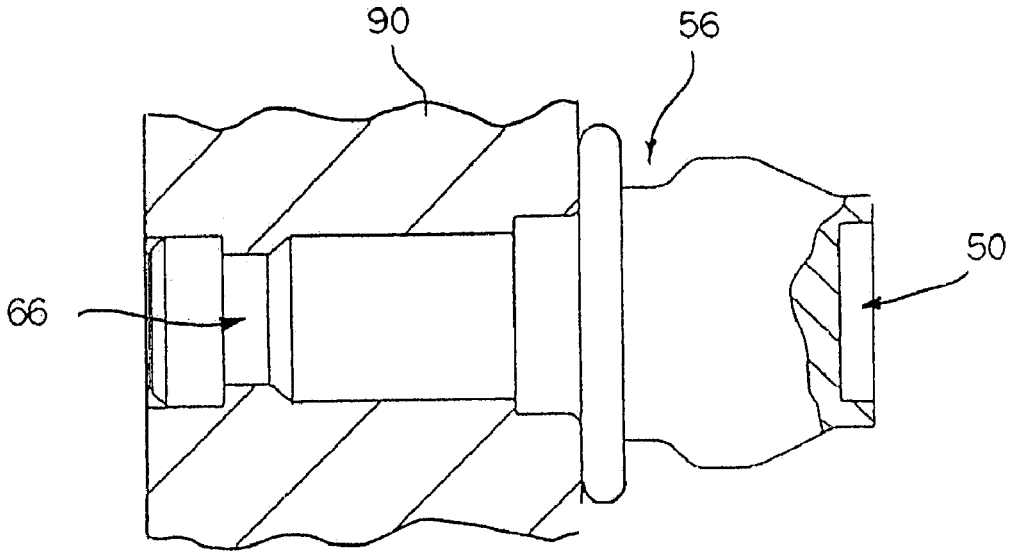
FIG. 8 is a cross-sectional view of the segmented dies surrounding the axial rearward portion of the cutting tool body showing the cold forming operation that forms the rearward portion of the cutting tool body.

FIG. 8 shows the die 90 wherein the rearward portion of the cutting tool body is being formed. In this operation, the retainer groove 66, as well as the other geometric features of the rearward portion, are formed through the cold forming process.

Figure 9:
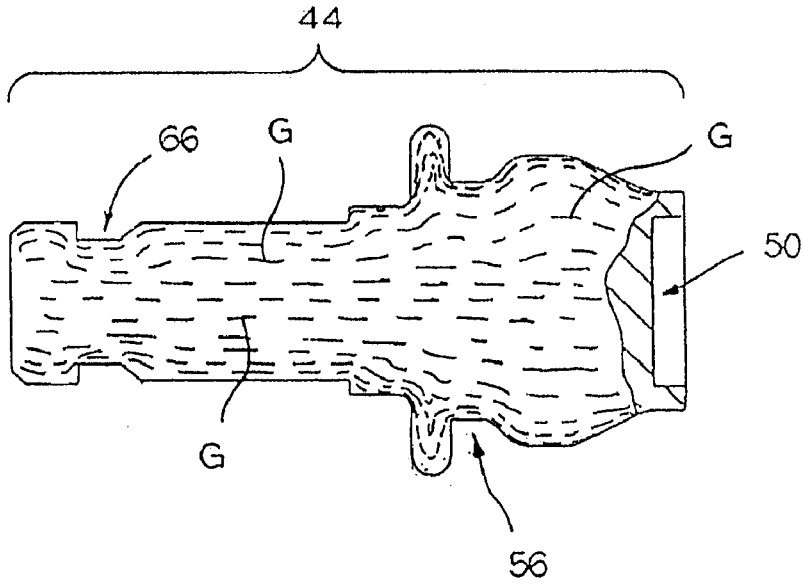
FIG. 9 is a side schematic view of the cutting tool body that shows the direction of the grain of the metal (e.g., steel) in the cold-formed cutting tool body wherein the orientation of the grain of the steel generally corresponds to the configuration of the peripheral surface of the cutting tool body.

FIG. 9 is a schematic side view that shows the direction of the grain (G) of the metal (e.g., steel) in the cold-formed cutting tool body. As can be seen from FIG. 9, the grain (G) of the steel generally follows the contour of the surface of the cutting tool body including generally following the contour of the surface in the area of the puller groove. By generally following the contour of the surface of the cutting tool body, the cutting tool body possesses increased strength as compared to a cutting tool body in which some of the portions (e.g., the puller groove) are machined out.

It can therefore be appreciated that the present invention provides an improved cutting tool body. More specifically, such improved cutting tool body exhibits improved strength properties especially in the area of the puller groove as compared to cutting tool body in which the puller groove is machined. Further, it can be appreciated that by avoiding the machining of portions of the cutting tool body (e.g., the puller groove) in the manufacture there is a reduction of the amount of raw material necessary to make the rotatable cutting tool.

All patents, patent applications, articles and other documents identified herein are hereby incorporated by reference herein. Other embodiments of the invention may be apparent to those skilled in the art from a consideration of the specification or the practice of the invention disclosed herein. It is intended that the specification and any examples set forth herein be considered as illustrative only, with the true spirit and scope of the invention being indicated by the following claims.

What is claimed is:

1. A method of making a cutting tool body comprising the steps of:

providing a stock material having an axial forward end; and simultaneously cold-forming a socket in the axial forward end of the stock material and a puller groove at a location axial rearward of the socket wherein the puller groove having a cylindrical mediate surface, and essentially not deforming the portion of the stock material that defines the cylindrical mediate surface of the puller groove during the simultaneous cold-forming of the socket and the puller groove.

2. The method of claim 1 further including the step of cold forming the stock material to form a rearward shank and a retainer groove in the rearward shank.

* * * * *